United States Patent [19]

Majerus

[11] 4,342,261

[45] Aug. 3, 1982

[54] SHAPED CHARGE WARHEAD WITH MECHANICAL MEANS FOR PREVENTING ROTATION

[75] Inventor: John N. Majerus, Rising Sun, Md.

[73] Assignee: The United States of America as represented by the Secretary of the Army, Washington, D.C.

[21] Appl. No.: 161,710

[22] Filed: Jun. 23, 1980

[51] Int. Cl.[3] ..... F42B 1/02

[52] U.S. Cl. ..... 102/307; 102/309

[58] Field of Search ..... 102/306, 307, 309

[56] References Cited

U.S. PATENT DOCUMENTS

| | | | |
|---|---|---|---|
| 3,112,701 | 12/1963 | Grebe | 102/306 |
| 3,154,014 | 10/1964 | Dunne | 102/309 X |
| 3,237,559 | 3/1966 | Auberlinder | 102/306 |
| 3,302,567 | 2/1967 | Venghiattis | 102/306 |
| 3,732,818 | 5/1973 | Thomanek | 102/306 |
| 4,043,266 | 8/1977 | Held | 102/306 |

*Primary Examiner*—Peter A. Nelson

*Attorney, Agent, or Firm*—Nathan Edelberg; Robert P. Gibson; A. Victor Erkkila

[57] ABSTRACT

Mechanical interference between a cast explosive material and a casing prevents rotation of the cast explosive material during machining thereof and improves symmetry and performance of the shaped-charge warhead. The cast explosive material may be keyed to the casing by flowing portions of the explosive material into a plurality of cavities in the casing before curing. Alternatively, pins may extend inward from the casing into the explosive material which surrounds them when cast and resists relative motion therebetween when cured. Alternatively, the explosive material may be pre-cast into an appropriate shape, cured and pressed into the casing. Protuberances to fit into holes in the casing or indentations to fit over pins extending into the casing may be formed on the pre-cast explosive. Engagement between the protuberances or indentations and the holes or pins respectively is attained when the explosive material is pressed into the casing.

9 Claims, 1 Drawing Figure

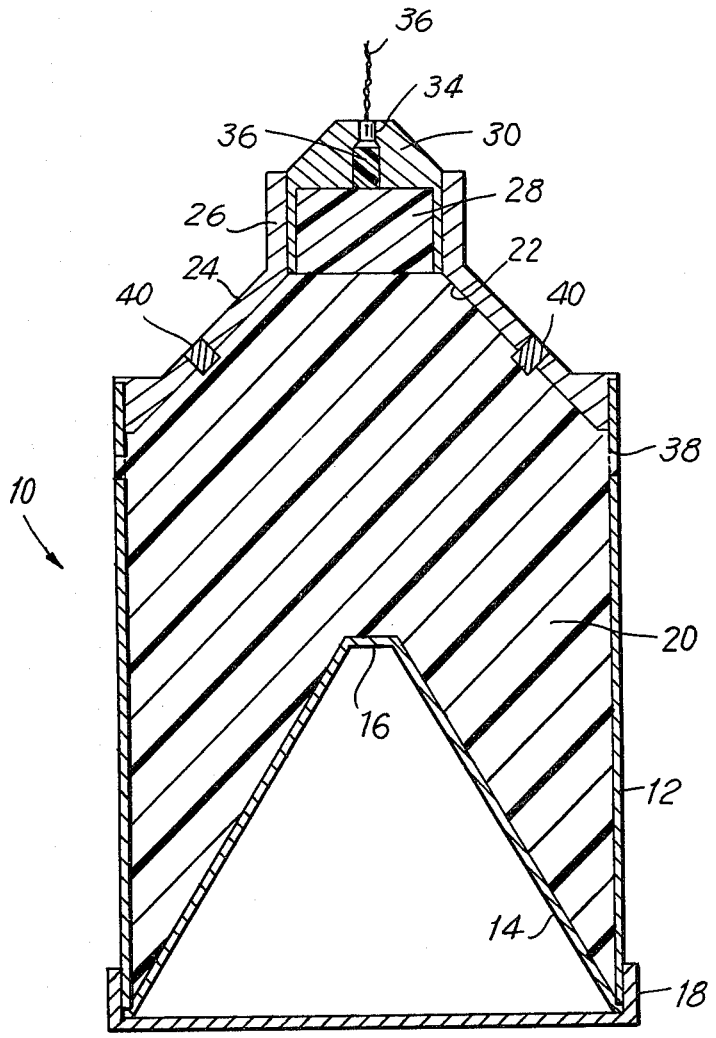
36
34
36
30
28
26
22
24
40
40
38
10
20
16
12
14
18

SHAPED CHARGE WARHEAD WITH MECHANICAL MEANS FOR PREVENTING ROTATION

GOVERNMENTAL INTEREST

The invention described herein may be manufactured, used and licensed by or for the Government for governmental purposes without the payment to me of any royalties thereon.

BACKGROUND OF THE INVENTION

The present invention relates generally to explosive charges, particularly as employed in projectiles and the like, and more specifically to explosive charges having a shaped body of explosive for enhancing penetration of remotely located material. Remotely located material is defined as material located a distance of about 20 times the diameter of the explosive charge along an axis of symmetry of the explosive charge.

In a projectile explosive charge such as, for example, a rocket-launched or tube-launched projectile, armor piercing capability of a given quantity of explosive is substantially improved by shaping the forward portion of the charge to produce a cavity of appropriate size and shape. The cavity may conventionally be lined with a metal or metallic alloy which is collapsed and driven as a concentrated, fast moving jet of metal which is capable of penetrating remotely located monolithic steel to depths of as much as two to three times the diameter of the warhead. An especially advantageous cavity shape is a conical shape having an included angle of less than 90 degrees and preferably from about 42 to 60 degrees.

Shaped charges are conveniently formed by casting a mass of explosive in a casing, the end of which is closed off by a metallic, preferably copper, cone. The cone thus forms the conical forward cavity of the shaped charge. After the explosive has set, it is conventional to machine the rear end of the explosive material to adapt it to fit a rear body section and/or an explosive booster, primer or centering device.

During machining of the rear portion of the cast explosive material, adhesion between the explosive material and the casing is relied on to prevent turning of the explosive material in the casing. The applicant has discovered that the bond between the cast explosive material and the casing is frequently unsatisfactory to prevent rotation of the explosive material in the casing. Such rotation disrupts the symmetry of the explosive, particularly near the junction of the cone and the casing where the section of explosive is quite thin. In addition, slight asymmetries in either the cone or the body produce corresponding asymmetries in the explosive material cast thereupon. Such asymmetries are exaggerated when the explosive material is rotated away from its original location.

Even if the bond is sufficient to resist rotation of the explosive mass in the body, localized fracture of the explosive material may occur due to the stress applied therebetween during machining.

The penetration performance of the shaped charge depends critically upon symmetry of each of the elements about the axial center line thereof. Anything which disrupts the symmetry of the charge also influences the symmetry of liner collapse. If the liner does not collapse in a symmetrical fashion, then the corresponding jet will not be straight and its penetration capability against remote targets is degraded.

Prior attempts to improve the armor piercing performance of shaped charge warheads include changing the shape or density of the liner, improving the axial alignment of liner, explosive material and explosive initiator and increasing the diameter of the shaped charge. Changing the shape and/or increasing the density of the liner greatly increases the cost for the different material and requires new machinery for fabrication. Improved axial alignment implies a drastic improvement in machining and fabrication technology since current shaped charges already utilize tolerances near the limits of high production technology. Increasing the diameter of the shaped charge requires that the entire system for launch must be correspondingly increased and the weight of the larger warhead may make it unsuitable for lifting by military personnel.

OBJECTS AND SUMMARY OF THE INVENTION

It is an object of the present invention to produce a shaped charge warhead which overcomes the drawbacks of the prior art.

It is a further object of the invention to produce a shaped charge warhead which resists asymmetry in a body of cast explosive material.

It is a further object of the invention to provide means for preventing the rotation of a body of cast explosive material in a casing during machining of a portion of the cast explosive material.

According to an aspect of the invention, there is provided a shaped charge warhead comprising a generally cylindrical casing, a cast mass of explosive material in the casing, means for forming a generally conical forward face of the mass of explosive material, and mechanical means for preventing rotation of the mass of explosive material in the casing.

According to a feature of the invention, there is provided a method of producing a shaped charge warhead comprising a mass of explosive material in a casing having a conical forward surface, mechanically keying the mass of explosive material to the casing, curing the mass, machining a rear surface of the mass for installation of a primer and a detonator, and the keying being effective to prevent relative rotation of the mass with respect to the casing during the machining.

The above, and other objects, features, and advantages of the present invention, will become apparent from the following description read in conjunction with the accompanying drawing, in which like reference numerals designate the same elements.

BRIEF DESCRIPTION OF THE DRAWING

The FIGURE is a cross section of a portion of a warhead according to an embodiment of the present invention.

DETAILED DESCRIPTION OF THE PREFERRED EMBODIMENT

Referring to the figure, a shaped charge, shown generally at 10, suitable for use in an aerodynamic enclosure (not shown) such as, for example, a rocket-launched or tubelaunched projectile, includes a generally cylindrical casing 12 having one end closed by a conical liner 14 of any suitable material but preferably of copper, axially symmetrically disposed within casing 12. Liner 14 may optionally have a truncated apex 16.

A retaining closure member 18 may optionally be employed for holding liner 14 in place.

A body of explosive material 20 is positioned within casing 12 in intimate contact therewith and with conical liner 14.

A booster retaining cell 26 at the extremity of rear body section 24 contains a booster charge 28 held accurately centered on rear surface 22 by a centering device 30. A detonator 32 is also held centered against the rear surface of booster charge 28 by centering device 30. An opening 34 in centering device 30 permits entry of detonating wires 36.

Two different methods may be used to fabricate shaped charge 10 in the structural relationship shown. In one method, explosive material 20 is poured as a flowable fluid into casing 12 through rear body section 24 when the components are fully assembled except for booster charge 28, centering device 30, detonator 32, and detonating wires 36. When this is done, an excess of explosive material 20 is poured so as to form a "pipe" or "chimney" to assure that all bubbles escape from the main body of explosive material 20 and all voids within casing 12 are filled. This excess fills the volume within booster retaining cell 26, and is removed by machining after explosive material 20 cools and hardens. Alternatively, explosive material 20 may be pre-cast in a mold to produce the necessary shape and dimensions to fit within casing 12 in nesting contact with liner 14 and rear body section 24. When pre-cast, explosive material 20 is formed with an excess of material to occupy cell 26 and must be machined in the same manner as for the cast-in-place method discussed above to make room for booster charge 28.

Casing 12 may have a plurality of locking holes 38 therein into which the explosive material may flow when the first fabrication method described above is used, and which, when set, provide mechanical interference between the body of explosive material 20 and casing 12 to prevent rotation of explosive material 20 during machining of rear surface 22. When the second fabrication method is used, the protusions to fit into locking holes 38 are preformed on the explosive and then are pressed into locking holes 38 in base 24 during assembly.

Locking holes 38 are preferably located as close as possible to the rear of casing 12 in order that the disturbance in pressure wave symmetry which they cause can be substantially damped out before the pressure wave reaches liner 14. For the same reason, a large number of small locking holes 38 is preferred to a few large locking holes.

An alternative or complementary rotation prevention device includes a plurality of locking pins 40 which may be placed, for example, in casing 12 or in rear body section 24 protruding into the volume occupied by explosive material 20. As explosive material 20 is cast in place, it surrounds locking pins 40 and, when set, engages locking pins 40 to prevent rotation of explosive material 20 in casing 12 and rear body section 24. When explosive material 20 is pre-cast, it may be provided with cast-in-place holes adapted to receive pins 40 which may be inserted later.

The size and number of locking pins 40 is related to the torsional resistance required, and to the detonation wave used to collapse the liner. In order to permit perturbations introduced into the detonation wave by the presence of locking pins 40 to damp out, they should be placed as far from the forward end of the shaped charge as possible. In addition, the size of the perturbations increase with the size of locking pins 40. Consequently, a larger number of smaller pins is preferred to a small number of large pins.

EXAMPLE 1

A five-inch diameter shaped charge warhead having a 60 degree included cone angle was fabricated with eight locking holes, each ¼ inch in diameter equally spaced about casing 12 approximately 1 inch forward of the forward surface of booster charge 28.

The shaped charge warhead was detonated at a distance of 20 charge diameters (CD) from monolithic steel. A similar shaped charge formed without the use of locking holes 38 was also detonated for comparison purposes. The charge formed without locking holes 38 penetrated the steel to a distance of 2.88 CD. The charge according to the present invention with locking holes 38 penetrated the steel to a distance of 3.50 CD. This is an improvement of 21 percent.

EXAMPLE 2

A 5.5 inch diameter shaped charge warhead having a 42 degree included cone angle was fabricated with eight locking holes, each ¼ inch in diameter equally spaced about the casing 12 approximately 1 inch forward of the forward surface of booster charge 28.

The shaped charge warhead was detonated at a distance of 20 charge diameters (CD) from monolithic steel. A similar shaped charge formed without the use of locking holes 38 was also detonated for comparison purposes. Th charge formed without the locking holes 38 penetrated the steel to a distance of 2.67 CD. The charge according to the present invention with locking holes 38 penetrated the steel to a distance of 3.15 CD. This is an improvement of 18 percent.

The cost of forming locking holes 28 in casing 12 is minimal.

Having described a specific preferred embodiment of the invention with reference to the accompanying drawing, it is to be understood that the invention is not limited to that precise embodiment, and that various changes and modifications may be effected therein by one skilled in the art without departing from the scope or spirit of the invention as defined in the appended claims.

I claim:

1. A shaped-charge warhead comprising:

a generally cylindrical casing having an open rear end and a forward end closed by a generally conical liner;

a solidified mass of explosive material in said casing in contact with said casing and said liner; and mechanical means for preventing rotation of said mass of explosive material in said casing.

2. A shaped-charge warhead according to claim 1; wherein said mechanical means includes a plurality of holes in a peripheral surface of said casing into which portions of said mass of explosive material flows during casting thereof and which acts upon said portions therein after curing of said mass of explosive material to prevent rotation thereof.

3. A shaped-charge warhead according to claim 1; wherein said mechanical means includes a plurality of cavities in an inner surface of said casing into which matching portions of said explosive material flows during casting thereof.

4. A shaped-charge warhead according to claim 1; wherein said mechanical means includes a plurality of inward-directed protuberances on said casing and matching indentations in said explosive material engaging said protuberances.

5. A shaped-charge warhead according to claim 4; wherein said explosive material is cast in said casing and flows about said protuberances during the casting thereof to form said matching indentations.

6. A shaped-charge warhead according to claim 4; wherein said explosive material is pre-cast including said matching indentations and said indentations are fitted to said protuberances during insertion of said explosive material into said casing.

7. A shaped-charge warhead according to claim 1; wherein said mechanical means includes a plurality of mechanical means symmetrically disposed about a circumferential region of said casing.

8. A shaped-charge warhead according to claim 1; wherein said mass of explosive material is cast in said casing.

9. A shaped-charge warhead according to claim 1; wherein said mass of explosive material is pressed into said casing.

* * * * *